US007798069B2

(12) United States Patent
Aitken

(10) Patent No.: US 7,798,069 B2
(45) Date of Patent: Sep. 21, 2010

(54) SUSPENSION FOR A RAIL VEHICLE

(75) Inventor: William Alan Aitken, Fife (GB)

(73) Assignee: SCT Europe Limited, Kirkcaldy (GB)

( * ) Notice: Subject to any disclaimer, the term of this patent is extended or adjusted under 35 U.S.C. 154(b) by 97 days.

(21) Appl. No.: 12/150,451

(22) Filed: Apr. 28, 2008

(65) Prior Publication Data

US 2008/0264292 A1 Oct. 30, 2008

Related U.S. Application Data

(60) Provisional application No. 60/946,196, filed on Jun. 26, 2007.

(30) Foreign Application Priority Data

Apr. 28, 2007 (GB) ..... 0708257.1

(51) Int. Cl.
*B61F 5/30* (2006.01)
*B61F 5/34* (2006.01)

(52) U.S. Cl. ..... 105/198.2; 105/171; 105/185; 105/224.06

(58) Field of Classification Search ..... 105/171, 105/182.1, 185, 198, 218.1, 218.2, 222, 223, 105/224.05, 224.06, 198.2, 198.4
See application file for complete search history.

(56) References Cited

U.S. PATENT DOCUMENTS 644,071 A * 2/1900 Gummi ..... 384/158.1
1,414,961 A * 5/1922 Kadel ..... 105/179
3,394,662 A * 7/1968 Weber ..... 105/165
4,109,586 A 8/1978 Briggs et al.
4,676,172 A * 6/1987 Bullock ..... 105/168
6,092,469 A * 7/2000 Monsell ..... 105/165

FOREIGN PATENT DOCUMENTS

| | | |
|---|---|---|
| DE | 2110072 | 9/1972 |
| GB | 2035238 | 6/1980 |
| WO | WO 2006/072800 | 7/2006 |

* cited by examiner

*Primary Examiner*—S. Joseph Morano
*Assistant Examiner*—Zachary Kuhfuss
(74) *Attorney, Agent, or Firm*—Bishop & Diehl, Ltd.

(57) ABSTRACT

A suspension for a rail vehicle includes a bogie pedestal 10, an axle box 11 and suspension springs 16, 18 and 19 arranged such that the axle box supports load exerted on the pedestal via the springs. The suspension includes a pair of wedge elements 20 urged, by means of springs 18 and 19, into engagement with faces 30 of the pedestal and faces 21 of the axle box. This engagement causes damping of axle box movements. Wedge elements 20 are urged resiliently in opposing directions A and B into frictional slidable contact at the faces 21 by means of additional preset springs 40 mounted at the pedestal 11. This further urging is independent of the load carried by the springs and provides improved suspension characteristics.

7 Claims, 1 Drawing Sheet

SUSPENSION FOR A RAIL VEHICLE

CROSS-REFERENCE TO RELATED APPLICATIONS

This application claims priority to United Kingdom Application No. GB0708257.1, filed Apr. 28, 2007, and U.S. Provisional Application No. 60/946,196, filed Jun. 26, 2007, both of which are expressly incorporated herein by reference and made a part hereof.

FEDERALLY SPONSORED RESEARCH OR DEVELOPMENT

Not Applicable.

TECHNICAL FIELD

This invention relates to a suspension for a rail vehicle.

BACKGROUND OF THE INVENTION

It is known in suspensions for rail vehicles for the main body of the vehicle to be suspended on a single or multi-axle bogie using suspensions which include a top pedestal supported by suspension springs which are in turn supported by an axle box attached to a wheel set by a bearing. Typically, as in the Barber Easy Ride Suspension, these suspensions include multiple long travel springs and have so called floating wedge friction damping. In this arrangement the friction damping is brought about by a fixed plate transmitting load to an inclined face of the wedge such that the vertical face of the wedge, having a composite liner, is forced against a respective vertical face of the axle box or saddle, on either side of the wheel/bearing centre line. This action results in a horizontal damping force acting towards the centre line, which produces resistive forces against lateral and vertical acceleration of the wheel set in the Y, Z plane (illustrated in FIG. 1) respectively due to the frictional engagement of the vertical faces. This damping force is load dependent, increasing generally linearly with increasing load on the vertical wedge support springs from tare to laden.

Under current arrangements instability in such suspensions can occur during high speed tare running of rail vehicles. This is particularly true for freight vehicles, which tend to be either run in their tare or fully laden states. Dynamic loading of the wedge brought about by varying loading on the vertical wedge support springs, which act on the wedge, can result in little or no force being exerted on the wedge. This in turn causes little or no damping of axle box movements. Additionally the axle box is permitted to yaw as it travels because the action of the wedge to hold the axle box in place is relaxed. This yawing action can lead to stability problems e.g. when travelling at high speed or on curving of the bogie.

SUMMARY OF THE INVENTION

According to a first aspect the present invention consists in a suspension for a rail vehicle including:

a bogie pedestal;

an axle box having a friction face;

a support for supporting the pedestal on the axle box, the support including a resilient portion;

and a wedge element mounted on the resilient portion to act between that portion and the pedestal, and for engaging the friction face when under load, characterised in that the support further includes a preset for urging the wedge element into contact with the friction face independent of any load carried by the support.

In a particularly preferred embodiment, the preset urges in a direction substantially parallel to the direction of intended travel of the bogie.

More particularly, said friction face may extend substantially vertically in use and the preset may act substantially horizontally.

The wedge may comprise a pair of wedges each being urged in opposing directions and said friction face of the axle box and a further face of the pedestal may comprise two respective pairs of faces, each face pair being engaged by one of the pair of wedges.

In that case each of the pair of wedges may have a support associated therewith forcing a respective wedge into said engagement with the faces of a face pair.

The face pairs may be inclined so that planes in which they generally lie have an acute angle between them.

In a particularly preferred embodiment the engagement of the wedge with the friction face of the axle box, in use causes damping of the movement of the pedestal relative to the movement of the axle box and wherein the urging of the preset does not substantially alter said damping action but does restrain the movement of the axle box in the direction of the urging.

According to a second aspect the invention consists in a suspension for a rail vehicle including:

a bogie pedestal including a pair of faces;

an axle box including a pair damping faces;

at least two support springs; and a pair of presets;

in use, the springs supporting, on the axle box, at least some of the load exerted on the pedestal and forcing said wedge elements into engagement with said faces of the pedestal and said damping faces of the axle box as a result of said load, the suspension being characterised in that the elements are resiliently urged into contact with the friction faces of the axle box which urging is independent of said load.

The invention extends to a method of controlling the movement of an axle relative to the pedestal of a bogie, the method employing a pedestal, an axle box, at least one resilient support arranged to resiliently support load from the pedestal on the axle box and at least one intermediate element urged, by means of the or each resilient support, into frictional sliding engagement with a face of the pedestal or a face of the axle box, characterised in that the method comprises the step of further urging said element into the sliding contact with one of the faces which urging is independent of any load carried by said at least one resilient support.

Although the invention has been outlined above it is to be understood that it includes any combination of the features set out above or in the following description.

BRIEF DESCRIPTION OF THE DRAWINGS

To understand the present invention, it will now be described by way of example, with reference to the accompanying drawing in which.

DETAILED DESCRIPTION

Figure 1:
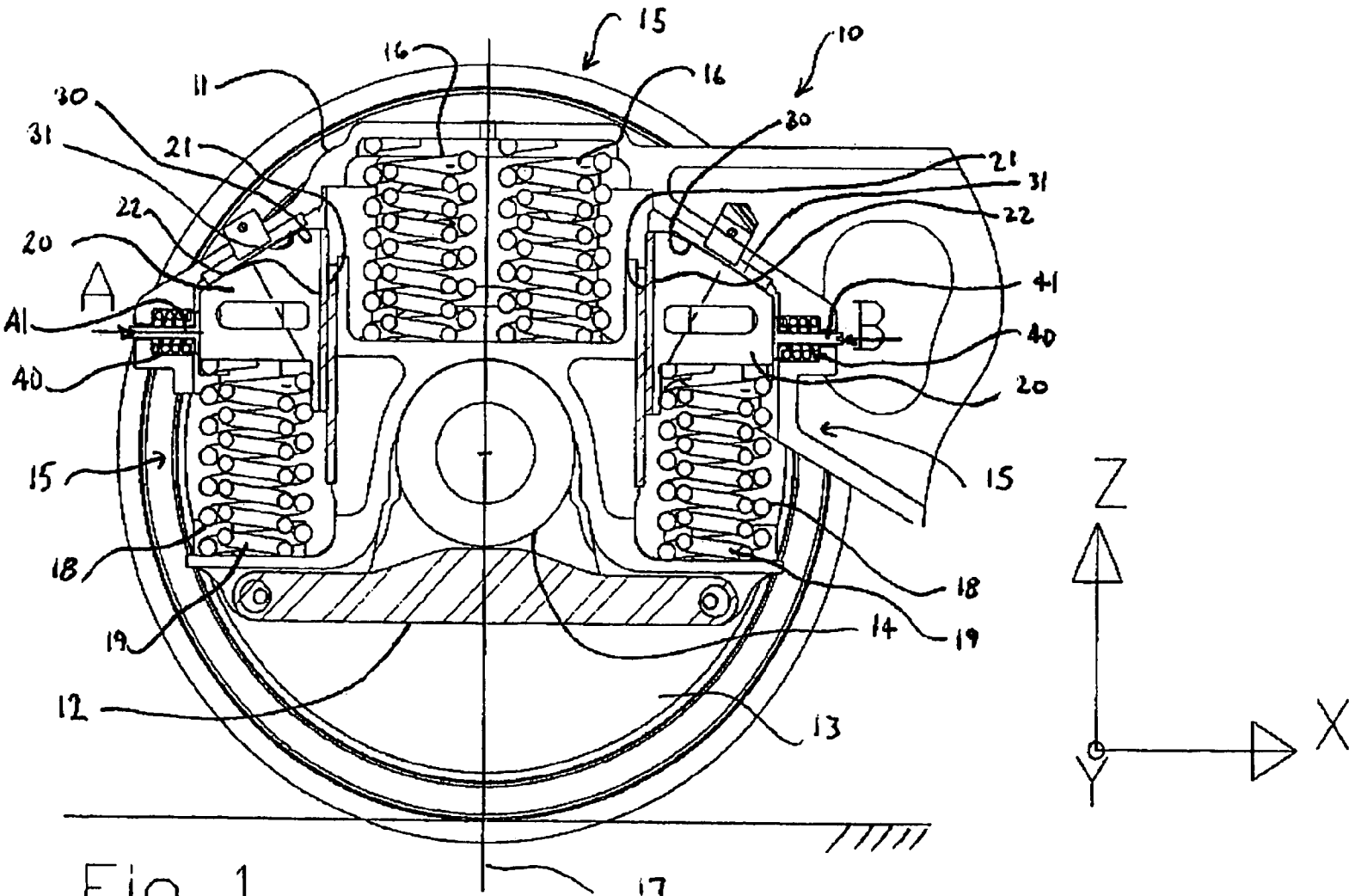
FIG. 1 is a side view of part of a bogie.

A part of a bogie 10 includes a top pedestal 11, that supports the body, for example, of a railway truck or passenger carriage (not shown), an axle box 12 which is attached to a wheel set 13 by a bearing 14, and a suspension system, generally indicated at 15 acting between the pedestal 11 and the axle box 12.

The suspension 15 includes two upper load bearing springs 16 mounted on respective sides of a centre line 17 and a pair of damping spring sets 18, which are also mounted on respective sides of the centre line 17.

Each spring set 18 includes coaxial springs 19 which together support an element, which is intermediate, the pedestal 11 and axle box 12, in this case wedge elements 20, which are constrained to travel vertically by the engagement of their faces 22 with one of a pair of vertical faces 21 on opposing sides of the axle box 12. Frictional sliding contact between each face 21 of the axle box 12 and each face 22 of the wedge elements causes damping of relative longitudinal movement between the axle box and the pedestal 11. The force required to produce the friction is brought about by the action of springs 18/19 forcing an upper face 30 of each wedge element 20 into engagement with one of two further respective inclined faces 31 of the pedestal 11. This action provides a component of the spring (18/19) force which forces the wedges into said frictional sliding contact with the axle box. Arrangements of this type are described in earlier co-pending applications of the Applicant. It will be noted that the upper face 30 of the wedge has a slightly convex surface to aid the alignment of faces 21 and 22.

In this arrangement the frictional force between faces 21 and 22 is dependent on the load applied to springs 18 & 19 and in turn on the load carried by the bogie 10. As detailed above tare running may result in instability when little or no urging force is exerted on the wedges 20. In order to at least reduce the above mentioned deficiencies, the embodiment shown provides a pair of further resilient members in the form of preset springs 40 which each act on a plunger 41 in horizontal directions A and B. The reaction faces of the springs are, in this instance, formed on the pedestal 11. The plungers act on the wedge elements 20 and urge faces 21 and 22 into slideable contact, but this urging is independent of the load carried by the bogie 10. The spring rate of springs 40 can be chosen such that the amount of force exerted on the wedge element is little compared to the amount required for damping but is sufficient to allow restraint of the axle box in the X direction. Such a spring rate will allow some damping under tare conditions but also inhibit undesirable yawing movements i.e., movements of the axle box in a plane parallel to X,Y plane illustrated, because the springs 40 will resist such movements.

One embodiment only has been described and illustrated but modifications, alternatives, variants etc. will be apparent to the skilled addressee. For example a symmetrical arrangement has been shown in the drawings thereby the same parts are employed on each side of an axle Centre 17.

However, it is possible that just one half of the arrangement could be employed with useful effect, the opposing side perhaps having no wedge mechanism, but rather directing abutting sliding faces of the axle box and pedestal. Alternatively on one side of the axle there could be arranged a swinging arm or the like cooperating with a suspension arrangement as described above on the opposing side of the axle. Mechanical springs have been illustrated for both the supports 15 and the presets 40, but their equivalents could be used to equal effect, e.g. compressible gas springs, resilient elastomeric bodies such as rubber, or opposing poles of magnets etc. The preset wedge springs 40 need not use plungers 41 and need not be mounted on the pedestal. These springs 40, or an alternative, could be mounted for example on the axle box whereby the wedges 20 may be pulled into the sliding, damping, contact described above. The urging force of the springs 40 will usually be preset to apply a specific force, but the springs or their equivalents can have adjustable force or variable force.

The embodiment shown provides a suspension with improved characteristics. The horizontal (X) stiffness of the suspension is such that high speed stability is improved. The passive steering ability of the axle box is improved because there is substantially constant horizontal stiffness. Stick-slip movement of the wedges 20 is reduced because the forces exerted on the wedges are more constant and X direction break-out forces are overcome by the constant horizontal stiffness across the suspension. The vertical (Z) and lateral (Y) stiffness of the suspension is substantially unchanged so less modification of existing parts is required for this embodiment to be implemented.

What is claimed is:

1. A suspension for a rail vehicle comprising:

a bogie pedestal;

an axle box having a friction face;

a support for supporting the pedestal on the axle box, the support including a resilient portion;

and a wedge element mounted on the resilient portion for action between that portion and the pedestal and for engaging the friction face when under load, wherein the support further includes a preset spring for urging the wedge element into contact with the friction face independent of any load carried by the support, and that the preset spring urges in a direction parallel to the direction of intended travel of the bogie.

2. The suspension as claimed in claim 1 wherein the friction face extends substantially vertically in use and the preset springs act substantially horizontally.

3. The suspension as claimed in claim 1 wherein the wedge comprises a pair of wedges each being urged in opposing directions and wherein the friction face of the axle box and a further face of the pedestal comprise two respective pairs of faces, each face pair being engaged by one of the pair of wedges.

4. The suspension as claimed in claim 3 wherein each of the pair of wedges has a support associated therewith forcing a respective wedge into engagement with the faces of a face pair.

5. The suspension as claimed in claim 3 wherein the respective faces of each face pair lie generally in planes which are acute.

6. The suspension as claimed in claim 1 wherein the engagement of the wedge with the friction face of the axle box, in use causes damping of the movement of the pedestal relative to the movement of the axle box and wherein the urging of the reset does not substantially alter the damping action but does restrain the movement of the axle box in the direction of the urging.

7. A suspension for a rail vehicle comprising:

a bogie pedestal including a pair of faces;

an axle box including a pair of damping faces;

a pair of wedge elements each acting between the pedestal and the axle box;

at least two support springs; and, a pair of preset springs;

the at least two support springs supporting, on the axle box, at least some of the rail vehicle load exerted on the pedestal and forcing the wedge elements into engagement with the faces of the pedestal and the damping faces of the axle box as a result of the load, wherein the wedge elements are resiliently urged into contact with the friction faces of the axle box independent of the load, and in a direction parallel to the direction of intended travel of the bogie.

* * * * *